US005799493A

United States Patent [19]

Morris et al.

[11] Patent Number: 5,799,493

[45] Date of Patent: Sep. 1, 1998

[54] CORROSION RESISTANT CRYOPUMP

[75] Inventors: Ronald N. Morris, North Falmouth; Doreen J. Ball-DiFazio, Hopkinton; Stephen R. Matté, Norfolk; Ernest D. Quintanilha, Norton, all of Mass.

[73] Assignee: Helix Technology Corporation, Mansfield, Mass.

[21] Appl. No.: 708,451

[22] Filed: Sep. 5, 1996

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 3,186,743 | 6/1965 | Russell, Jr. | 285/238 |
| 3,712,074 | 1/1973 | Boissin | 62/55.5 |
| 3,857,161 | 12/1974 | Hitchins, IV | 29/472.7 |
| 3,929,358 | 12/1975 | Eckhardt | 285/353 |
| 4,192,519 | 3/1980 | Buggele | 277/115 |
| 4,207,746 | 6/1980 | McFarlin | 62/55.5 |
| 4,218,067 | 8/1980 | Halling | 277/205 |
| 4,540,186 | 9/1985 | Beidler | 277/195 |
| 4,719,938 | 1/1988 | Pandorf | 62/55.5 X |
| 4,817,964 | 4/1989 | Black, Jr. | 277/1 |
| 4,876,413 | 10/1989 | Vermilyea | 174/15.4 |
| 4,896,816 | 1/1990 | Lascar et al. | 228/122 |
| 4,930,676 | 6/1990 | McNaught et al. | 228/115 |
| 4,976,111 | 12/1990 | Larin | 62/55.5 |
| 5,014,517 | 5/1991 | Larin et al. | 62/55.5 |
| 5,033,756 | 7/1991 | Sixsmith et al. | 277/188 |
| 5,139,288 | 8/1992 | Najm et al. | 285/50 |
| 5,305,612 | 4/1994 | Higham et al. | 62/55.5 |
| 5,405,176 | 4/1995 | Babel et al. | 285/382 |
| 5,611,208 | 3/1997 | Hemmerich et al. | 62/55.5 |

OTHER PUBLICATIONS

Brochure, "ECI Metal C–Ring, Internal Pressure Face Seal," Advanced Products, pp. C–2 & C–3.

*Primary Examiner*—Christopher Kilner

*Attorney, Agent, or Firm*—Hamilton, Brook, Smith & Reynolds, P.C.

[57] ABSTRACT

A cryopanel is formed of aluminum to avoid copper ions in a work chamber, and the aluminum is coated with a Teflon® polymer for corrosion resistance. A corrosion resistant thermally conductive link is obtained by surrounding indium with a polymer coated C-ring. The cryopanel is shaped as a trough to enable draining of liquid during regeneration.

25 Claims, 2 Drawing Sheets

CORROSION RESISTANT CRYOPUMP

BACKGROUND

Cryopumps are used to create high vacuum in many applications including semiconductor processing and the application of coatings. Cryopanels are cooled to cryogenic temperatures at which gases are condensed or adsorbed from a chamber, such as a work chamber, transfer chamber or load lock, being vacuum pumped or atmosphere as in a load lock. The temperatures at which cryopanels operate is dependent on the gases in the environment being pumped. For gases having very low temperatures of condensation, a two-stage refrigerator which cools a second stage cryopanel to about 10K may be required. In other applications where water is the principal species of interest, a single stage refrigerator cooling a cryopanel to a temperature in the range of 90K to 120K may be used and is called a waterpump. Usually, the cryopanels are cooled by a closed cycle refrigerator, though liquid cryogens such as liquid nitrogen and liquid helium may also be used to cool the cryopanels.

Because of the need for high thermal conductance and diffusivity, copper, or nickel plated copper, is the usual choice of material for cryopanels. However, within the etch segment of the semiconductor industry there is a desire to avoid mobile ions which result from copper and other group VIII and group IB and IIB elements of the periodic table.

Since cryopumps are capture pumps, they must be periodically regenerated to remove the elements which have been collected on the cryopanels. To that end, the cryopanels are heated, and the elements are liquefied or evaporated and removed from the system. The liquefied elements can be very corrosive.

SUMMARY OF THE INVENTION

A cryopanel and a cryopump, such as a water pump, using the cryopanel of the present invention are particularly suited to corrosive environments. In accordance with one aspect of the invention, the cryopanel is coated with a corrosion resistant polymer. Preferably the polymer is a halogenated or perhalogenated alkenyl or alkoxy polymer of $C_1$ to $C_4$ repeat units, including copolymers thereof, wherein the repeat units are substantially halogenated with fluorine, chlorine or combinations thereof. To avoid group VIII, IB and IIB elements, yet obtain the necessary conductivity and diffusivity, aluminum is the preferred choice of underlying material.

In accordance with another aspect of the invention, a conductive link between the refrigerator and cryopanel comprises a soft, high thermal conductivity material, preferably indium, pressed between opposing surfaces, and the soft material is surrounded by a seal ring which protects it from the corrosive environment. Preferably, that seal ring is a resilient metallic seal, most preferably a Teflon® PTFE coated C-ring.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
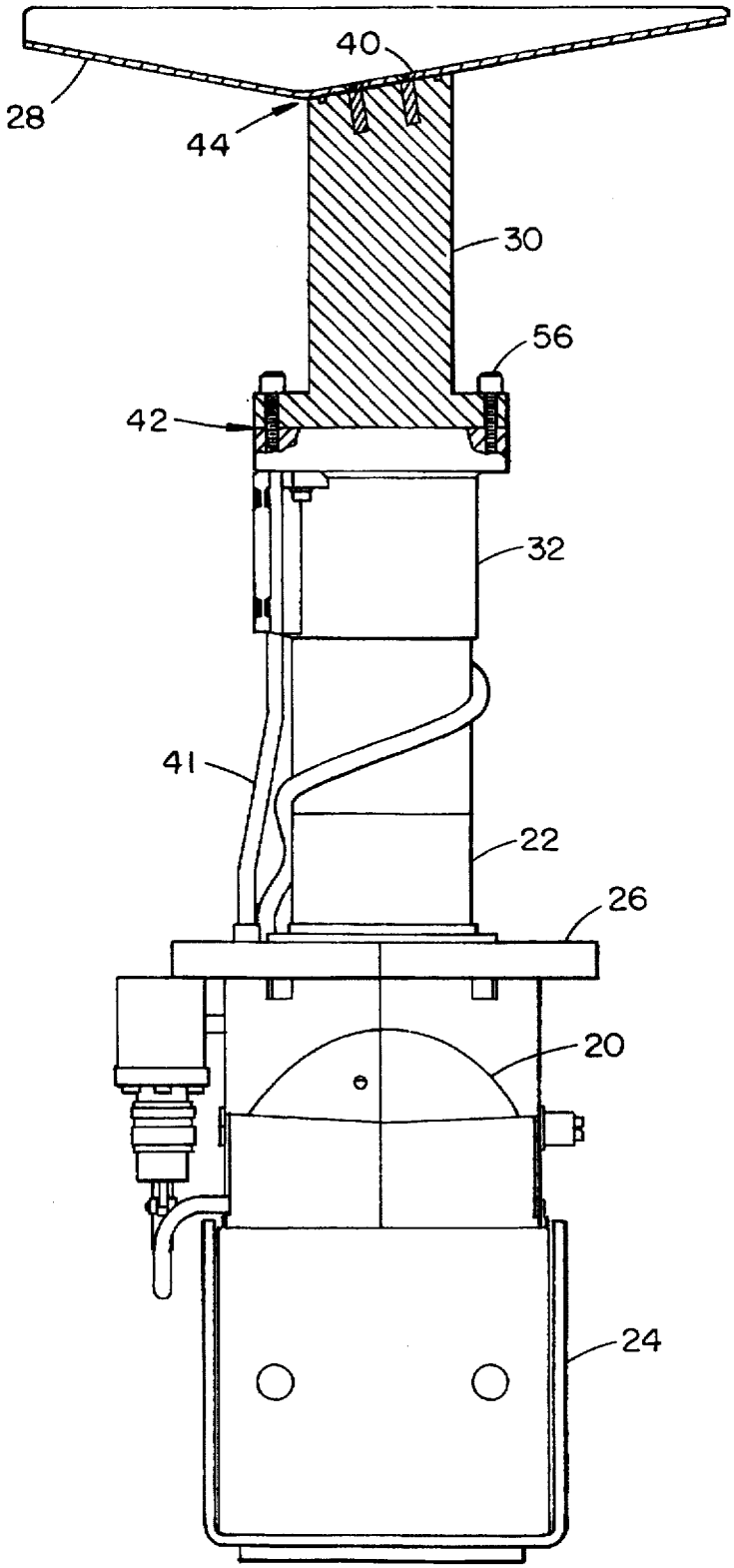
FIG. 1 is a side view, partially in cross section, of a waterpump embodying the present invention.

FIG. 1 illustrates a single stage waterpump particularly suited to the capture of water vapor within a work chamber. The single stage refrigerator includes a motor 20 for driving a displacer within a cold finger 22 in a Gifford-McMahon refrigeration cycle. The system is controlled by electronics 24 which in this system are integral with the cryopump assembly. A flange 26 enables the cryopump to be mounted at a port in a work chamber, transfer chamber or loadlock with the cold finger 22 extending into the chamber.

Figure 2:
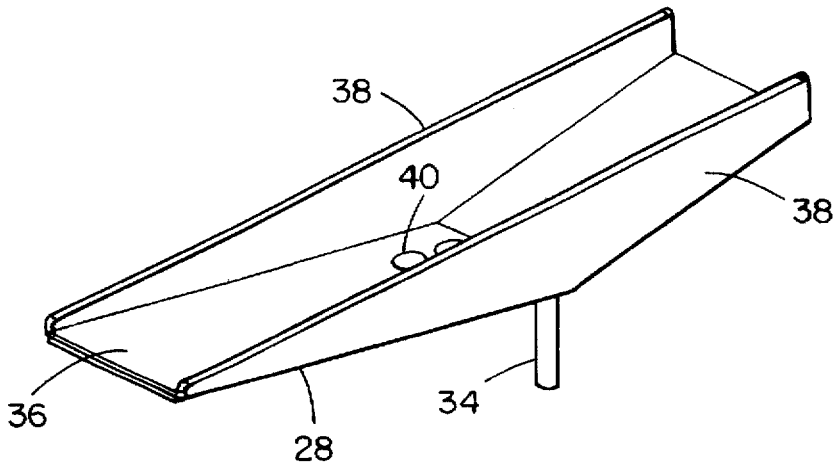
FIG. 2 is a perspective view of the cryopanel of the waterpump of FIG. 1.

A cryopanel 28 is mounted at the distal end of the cold finger and is cooled to temperatures of about 107K for condensing water. To suitably locate the cryopanel 28 within the chamber, a conductive post 30 provides a cold link between the heat station 32 at the end of the cold finger 22 and the cryopanel 28. As illustrated in FIG. 2 where the cryopanel is viewed from the rear of FIG. 1, the cryopanel is formed as a trough in order to collect liquefied elements during regeneration and to direct the liquid to a drain tube 34. The trough is a simple V shaped base 36 with end walls 38. The V is asymmetric in order to permit bolt holes 40, for mounting to the post 30, to be positioned on a flat surface.

A heater 41 is controlled by the electronics 24 to maintain a desired temperature. In a preferred waterpump application that temperature is 107K.

To be suitable for serving as a cryopanel, the material of the cryopanel should be of high thermal conductivity and more particularly of high thermal diffusivity, the ratio of thermal conductivity to the product of density and specific heat ($k/\rho C_p$). Thermal diffusivity is a measure of the energy transfer across the element relative to the energy stored within the element and is a good figure of merit for cryopanel material. A comparison of thermal diffusivity of three metals at both ambient temperature and 100K is presented in the following table.

TABLE 1

| MATERIAL | DIFFUSIVITY AT 300K UNITS OF IN^2/SEC | DIFFUSIVITY AT 100K UNITS OF IN^2/SEC |
|---|---|---|
| Aluminum | .147 | .290 |
| Magnesium | .150 | .226 |
| Copper | .174 | .306 |

It can be seen from the above table that copper is the best choice, but with the requirement that copper free ions be avoided in some applications, aluminum becomes the choice in those applications.

Although aluminum alone can withstand many corrosive environments, to provide additional resistance to corrosion the aluminum is preferably coated with a corrosion resistant polymer. Preferably the polymer is a halogenated or perhalogenated alkenyl or alkoxy polymer of $C_1$ to $C_4$ repeat units, including copolymers thereof, wherein the repeat units are substantially halogenated with fluorine, chlorine or combinations thereof. Suitable halogenated or perhalogenated polymers include, for example, Teflon® (E. I. Du Pont de Nemours and Company, polytetrafluoroethylene, PTFE), Teflon® PFA (E. I. Du Pont de Nemours and Company, Product Code 857210, perfluoroalkoxy polymer), Teflon® FEP Green (E. I. Du Pont de Nemours and Company, Product Code 856204, fluorinated ethylene-propylene copolymers), Teflon® FEP Black (E. I. Du Pont de Nemours and Company, Product Code 856200, fluorinated ethylene-propylene copolymers), Teflon® ETFE clear (E. I. Du Pont de Nemours and Company, Product Code 5326010, ethylene trifluoroethylene), Teflon® ETFE Green (E. I. Du Pont de Nemours and Company, Product Code 5326014, ethylene trifluoroethylene), Halar® (Whitford, Product Code 6014, ethylene chlorotrifluoroethylene), Kynar® (Ausimot, Inc., polyvinylidene fluoride) KF® (Continental Industries, Inc., polyvinylidene fluoride) and PVF2 (Continental Industries, Inc. polyvinylidene fluoride). Prior to coating of the metal surface with a halogenated or perhalogenated polymer, the surface of the metal is preferably treated with a primer. Primers, for example, include Teflon® PFA primer (E. I. Du Pont de Nemours and Company, Product Code 958203, polyamide imide combined with fluoroethylene-propylene), Teflon® FEP Green primer (E. I. Du Pont de Nemours and Company, Product Code 850314, chromic acid/phosphoric acid combined with polytetrafluoroethylene, PTFE), Teflon® FEP Black primer (E. I. Du Pont de Nemours and Company, Product Code 958203, polyamide imide combined with fluoroethylene-propylene), Teflon® ETFE primers (E. I. Du Pont de Nemours and Company, Product Code 699123, mixture of fluoropolymer powder and cobalt oxide), Halar® primer (Whitford, 6614 mixture of fluoropolymers and cobalt oxide), and KF® and PVF2 primers (Continental Industries, Inc., polyvinylidene fluoride and 2 percent epoxy). In a most preferred embodiment, the metal surface is first treated with a Teflon® PFA primer followed by treatment with Teflon® PFA.

As can been seen in Table 2, the Teflon® PFA coating reduces the corrosion to zero during 120 hours of testing at room temperature in dilute acid solution.

TABLE 2

| | Weight Loss at 23 C., mg/in$^2$ | | |
|---|---|---|---|
| Material | 24 hours | 48 hours | 120 hours |
| Aluminum | 89.4 | 178.6 | 351.7 |
| Teflon ® PFA on Aluminum | 0 | 0 | 0 |

The above noted polymers would also be an advantageous choices for coating other cryopanel arrays such as copper arrays. Preferably, the other condensing elements of the system, the heat station 32 and the cold link 30, are also of aluminum and are also coated with Teflon® PFA for corrosion resistance, though the most significant coating is on the cryopanel.

Indium is a soft, high conductivity metal which is conventionally used to provide a good conductive link between two materials. Being soft, it flows under pressure to assure excellent surface contact with each of the mating services, and it has high thermal conductivity at cryogenic temperatures. Unfortunately, the soft indium can be corroded in harsh environments. In accordance with another aspect of the present invention, the conventional indium conductive link is sealed from the surrounding environment by a seal ring. A preferred seal ring is a C-ring of PTFE coated 718 alloy such as that manufactured by Advanced Products Company.

Figure 3:
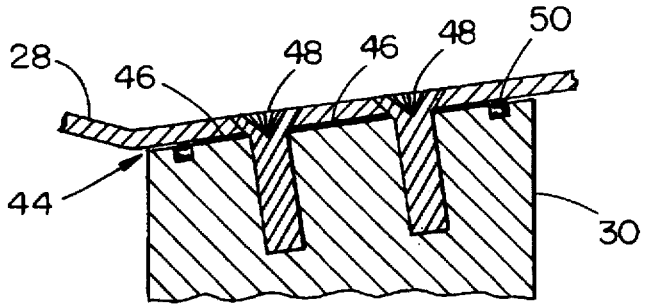
FIG. 3 is an enlarged sectional view of the conductive link between the cryopanel and a conductive post.

Indium conductive links are provided at 42 between the heat station 32 and the cold link 30 and at 44 between the post 30 and the cryopanel 28. The latter is shown enlarged in FIG. 3. As illustrated, a layer of indium 46 is pressed between the cryopanel 28 and the post 30 by bolts 48. A resilient metallic seal ring 50, of C-cross section, is positioned in a groove which surrounds the indium, and the seal is also pressed between the cryopanel 28 and the post 30. The seal ring need not provide a conductive link, that function being served by the indium, but it does provide a gas and liquid seal to protect the indium from the surrounding corrosive environment.

Figure 4:
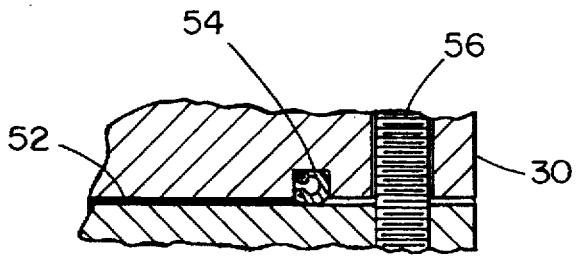
FIG. 4 is an enlarged cross-sectional view of a conductive link between the refrigerator and the conductive post.

Similarly, the conductive link 42 is illustrated in FIG. 4. Indium 52 is surrounded by a C-ring 54 seated within a groove in the post 30. The C-ring and the heat station are pressed together by bolts 56.

While this invention has been particularly shown and described with references to preferred embodiments thereof, it will be understood by those skilled in the art that various changes in form and details may be made therein without departing from the spirit and scope of the invention as defined by the appended claims.

EXPERIMENTAL

From a literature study, a number of candidates for a corrosion resistant coating were identified. Those candidates were then tested as follows to select a preferred coating.

(1) Total Mass Loss (TML)

This method is based on NASA test method #N91-14437. The total outgassing percentage from an organic coating is determined during a 125° C. bake out under vacuum. A stainless steel substrate was used in the test. The weight of the substrate was subtracted from the total sample weight to calculate the coating sample weight. The substrate weight was determined by the averaging of 3 different stainless steel bare coupons. Bare coupons weight for each coating was assumed to be the same. All candidate coatings, Nylon, Teflon® FEP Black, Teflon® PFA, Epoxy, Teflon® FEP Green, Halar®, PVDF2, were used in this initial screening test. The percentage weight loss after the bake out was calculated to provide the total mass loss percentage.

TABLE 3

| | Total Mass Loss | | | | | | |
|---|---|---|---|---|---|---|---|
| Sample | Wt. 1 (gm) | Wt. 2 (gm) | Wt. Loss (gm) | Sample Wt. (gm) | Wt. Loss % | Color Thickness (mil) | Color |
| Nylon | 22.73357 | 20.72612 | 2.00745 | 3.44625 | 58.250 | 3.5–6 | Grey-White |
| Teflon ® FEB Black | 20.09942 | 20.099498 | 0.00444 | 0.81210 | 0.547 | 1.5–2 | Black |

TABLE 3-continued

| Sample | Wt. 1 (gm) | Wt. 2 (gm) | Wt. Loss (gm) | Sample Wt. (gm) | Wt. Loss % | Color Thickness (mil) | Color |
|---|---|---|---|---|---|---|---|
| | | | Total Mass Loss | | | | |
| Teflon ® PFA | 20.61501 | 20.61065 | 0.00436 | 1.32769 | 0.328 | 2–3 | Black |
| Epoxy | 22.02158 | 22.01360 | 0.00798 | 2.73426 | 0.292 | 5 | Green-Blue |
| Teflon ® FEP Green | 20.30448 | 20.30301 | 0.00147 | 1.01716 | 0.145 | 1.5–2 | Green |
| Halar ® | 22.94025 | 22.93908 | 0.00117 | 3.65293 | 0.032 | 8–10 | Dark Green |
| PVDF2 | 21.28151 | 21.28095 | 0.00056 | 1.99419 | 0.028 | 3–5 | Black |

The coating with the lowest total mass loss was PVDF2 and the coating with highest mass loss was Nylon. Three coatings from the lowest TML % were selected for further tests. Even though Teflon® FEP Green was the third option per TML %, Teflon® PFA was selected for further testing instead, because of its color. The TML % of the three selected coatings, PVDF2, Halar® and Teflon® PFA, were 0.028%, 0.032% and 0.328%.

(2) Organic Outgassing

This method was used to identify the type of organic outgassing species from coated samples. Gas Chromatography/Mass spectrometry (GC/MS) equipment was used as the detection technique. After the initial screening from total mass loss, three coatings (Halar®, PVDF2 and Teflon® PFA), were selected for further tests. Three coating samples with stainless steel substrates were prepared in an individual test vessel. Prior to sample preparation, test vessels were cleaned in aqueous cleaner Alconox and baked at 100° C. overnight. Sample containing test vessels were purged/charged with Helium gas for 10 times and finally charged with approximately 70 psig Helium, and heat soaked at 100° C. for 17 hours. The gas sample from the test vessel was sampled by liquid nitrogen cryofocus module and tested by GC/MS.

Test parameters are as follows:

GC temperature program: –40° C. for 8 min., 5° C./min to 20° C., 15° C./min to 275° C., 3 min hold GC column: Fused silica capillary 30 m×0.25 mm×0.25 u GC injector temperature: 275° C.

GC/MS interface temperature: 280° C.

Ion source temperature: 200° C.

Mass range: m/z 10 to 600

Emission current: 300 uA

Electron Energy: 70 eV

Multiplier voltage: 2291

Organic Outgassing (GC/MS)

The major outgassing species from the Halar®, PVDF2 and Teflon® PFA were carbon dioxide and water. Other organic outgassing species were at insignificant levels (<0.01 ul/gm). The relative levels of water were found to be highest in the Teflon® PFA and lowest in the PVDF2, however, this could possibly be from the atmospheric moisture or the sample vessel.

Since the quantity of the coating material prepared in the Halar® vessel was twice that of the PVDF2 and Teflon® PFA, the comparison of the corrected mass area from the Halar® coating should have been half of its value. Accordingly, the relative levels of carbon dioxide were found to be similar between the three samples.

(3) Water Absorption

This method is similar to ASTM 570-81. The maximum quantity of water absorbed by the coating was determined. Two substrates (stainless steel and nickel-plated copper), and three coatings (Halar®, Teflon® PFA and PVDF2) were used in this test. Samples were preconditioned in a 55° C. oven for 24 hours, cooled in a desiccator and weighed. The conditioned samples were then entirely immersed in distilled water for 24 hours. Samples were removed from the water and wiped off with a dry cloth, and re-weighed. The percentage weight gain was calculated to provide the water absorption with the coating weight estimated by subtracting the average substrate weight.

Table 4 is a summary of test results.

TABLE 4

| | Wt. 1 | Wt. 2 | Wt. Gain | Coating Org. wt. | % Wt Gain |
|---|---|---|---|---|---|
| | | Water Absorption | | | |
| | | Stainless Steel Bare Coupon Wt: 43.2974 | | | |
| HALAR ® | 46.3530 | 46.3544 | 0.0014 | 3.0556 | 0.0458 |
| Teflon ® PFA | 45.1690 | 45.1747 | 0.0057 | 1.8716 | 0.03046 |
| PVDF2 | 46.7641 | 46.7674 | 0.0033 | 3.4667 | 0.0952 |
| | | Ni Plated Copper Bare Coupon Wt: 44.5762 | | | |
| HALAR ® | 49.6877 | 49.6907 | 0.0030 | 5.1115 | 0.0587 |
| Teflon ® PFA | 47.2287 | 47.2369 | 0.0082 | 2.6525 | 0.3091 |
| PVDF2 | 49.5467 | 49.5505 | 0.0038 | 4.9705 | 0.0765 |

The coating showing highest water absorption was Teflon® PFA and the coating with the lowest water absorption was Halar®. As expected the values were independent of substrate composition. The water absorption % from the three selected coatings, Halar®, Teflon® PFA and PVDF2, on stainless steel substrates were 0.046%, 0.305% and 0.095%, respectively. The water absorption % were relatively low. No dimension or appearance changes were noted in this test.

(4) Corrosion and Stress Corrosion Cracking Tests

This method is similar to ASTM G123-94. This method provided a means of evaluating and comparing basic corrosion performance and stress corrosion cracking of a substrate and a coating system after exposure to corrosive environments.

Three coatings (Halar®, Teflon® PFA and PVDF2) coated on two substrates (stainless steel and nickel-plated copper) were used in this test. Substrates were cut to 2"×5" dimensions. Stainless steel substrates were welded in the center to stimulate the actual condition in a waterpump. The stainless steel welded coupons and electroless nickel-plated cooper coupons were sent to Applied Plastics Co., for coating. Three substrates without coating (welded stainless steel, nickel-plated copper, indium) were also tested for reference. The tests were performed in three 5% V (volume %) acid solutions (HCl, HBr, HF) at four different temperatures (room temperature, 35° C., 60° C., 95° C.).

Prior to testing in the acid solutions, substrate coupons and coated coupons were stressed around a 0.5" diameter mandrel until the legs of the U bend were nearly parallel. The compounds were examined visually for cracks or other defects. The legs of the bent coupons were tightened together. Corrosion resistant materials (example: Teflon®) must be used for the stressing fastener, nuts and washers.

The bent samples were placed in a kettle body glass cylinder (Lab glass #LG-8075-100). The coupons were separated and the stressed area was free from direct contact with the heated surface. 5% acid solution (HCl or HBr or HF) was added to the test cylinder (the samples) were fully submerged. The test cylinder was placed on a hot plate, covered with a 3 port cover (Lab glass #LG-8076-100), and then the cylinder and cover were tightened with a clamp. A condenser, thermometer and glass stopper were placed in three individual ports of the cover. The condenser was connected with rubber tubes to regulate water flow. The test cylinder was wrapped with an insulation blanket and the hot plate temperature regulated to desired temperature. The samples were removed from the test cylinder after 7 days, rinsed with DI water for 1 minute, and wiped to dry with a cloth. The samples were then examined for cracking and other corrosion failure.

Table 5 is a summary of test results. The result "good performance" refers to no pitting, discoloration and blistering.

TABLE 5

CORROSION TEST

| | 5% HF | | | | 5% HBr | | 5% HCl | |
|---|---|---|---|---|---|---|---|---|
| Sample | RT | 35° C. | 60° C. | 95° C. | 60° C. | 95° C. | 60° C. | 95° C. |
| Welded Stainless Steel | | | | | | | | Corrode pit |
| Ni Plated Copper | | | | | | | | Corrode |
| Indium | | | | | | | | Dissolved |
| Teflon ® PFA (stainless steel) | Good | Good | Good | Bad (dull) | Good | Good | Good | Peel (edge) |
| Teflon ® PFA (Ni plated) | X | X | Good | Bad (dull) | Good | Good | Good | Good |
| HALAR ® (stainless steel) | Discolor | Discolor | X | X | X | X | X | Discolor & Peel |
| HALAR ® (Ni plated) | X | X | X | X | X | X | X | Discolor |
| PVDF2 (stainless steel) | Good | Good | Blister | X | Blister | X | Blister | Blister |
| PVDF2 (Ni plated) | X | X | X | X | X | X | | |

Three substrates (welded stainless steel, nickel-plated copper and indium) without coatings were tested at 95° C. in 5% v HCl solution. Stainless steel and nickel plated copper corroded on 100% of their surface areas. The weld line on the stainless steel pitted in several spots. Indium was completely dissolved.

5% v Hydrofluoric Acid Solution

At room temperature and 35° C., Teflon® PFA and PVDF2 (stainless steel substrate) exhibited good performance. Halar® (stainless steel substrate) discolored on many areas. Since Halar® had inferior corrosion resistance even at room temperature, Halar® was not considered for higher temperature testing.

At 60° C., Teflon® PFA exhibited good performance on stainless steel and nickel-plated copper substrates. PVDF2 (stainless steel substrate) blistered on many areas.

At 96° C., Teflon® PFA (stainless steel and nickel-plated copper) exhibited poor surface quality. The color of the coating became dull. Thus, it was determined that Teflon® PFA can perform well at a temperature up to 60° C. in 5% v HF for one week.

5% v Hydrobromic Acid Solution

At 60° C., Teflon® PFA performed well on both substrates (stainless steel and nickel-plated copper). PVDF2 (stainless steel substrate) blistered on many areas as in the 5% v HF solution.

At 95° C., Teflon® PFA exhibited good performance on both substrates.

5% v Hydrochloric Acid Solution

At 60° C., Teflon® PFA performed well on both substrates. PVDF2 blistered on many areas as noted in 5% v HF and 5% v HBr solutions.

At 95° C., Teflon® PFA performed well on nickel plated copper, substrate. Some peelings at edge areas occurred on the stainless steel substrate coated with Teflon® PFA.

Halar® did not survive the acid test conditions even at room temperature. PVDF2 can survive at 35° C. but exhibited blistering at 60° C. Teflon® PFA can survive up to 60° C. in 5% v HCl, HBr and HF solutions for 7 days. No substrate cracking was found in any of these tests. For that reason, PFA was selected as the preferred coating.

(5) Thermal Shock

This method was intended to evaluate how cryogenic temperature can affect the coating performance. Two substrates (stainless steel and nickel-plated copper) with Teflon® PFA coated samples were used in the test.

Samples were immersed in liquid nitrogen until boiling stopped. The parts were removed from liquid nitrogen, warmed with a heat gun, and examined visually for peeling, cracking and surface irregularities. This step was repeated 25 times.

(6) Adhesion (bend test)

This method is similar to ASTM B571-91. This method was used to evaluate the adhesion of a coating material to a substrate under tension. Two substrates (stainless steel and nickel-plated copper) with Teflon® PFA coated samples were used in this test.

The samples were bent over a 0.5" diameter mandrel until the legs of the U bend were parallel. The deformed area was examined visually for peeling or flaking. The samples were bent repeatedly, back and forth, through an angle of 180 degree for a total of 10 cycles.

Teflon® PFA exhibited no cracking or peeling on both substrates (stainless steel and nickel-plated copper) in the thermal shock and adhesion (bend) tests.

What is claimed is:

1. A cryopump comprising:

a cryogenic refrigerator; and a cryopanel of high conductivity material cooled by the cryogenic refrigerator, the cryopanel having a corrosion resistant polymer coating, wherein said corrosion resistant polymer coating is a halogenated or perhalogenated alkenyl or alkoxy polymer or a copolymer thereof having $c_1$ to $c_4$ repeat units, wherein said repeat units are substantially halogenated with fluorine, chlorine or combinations thereof.

2. A cryopump as claimed in claim 1 wherein said halogenated or perhalogenated polymer is a perfluoroalkoxy polymer.

3. A cryopump as claimed in claim 1 wherein the cryopanel is formed of aluminum.

4. A cryopump as claimed in claim 3 further comprising a conductive link between the refrigerator and the cryopanel, the link comprising a soft high conductivity material pressed between opposing surfaces and a seal ring surrounding the pressed material.

5. A cryopump as claimed in claim 4 wherein said soft material is indium.

6. A cryopump as claimed in claim 5 wherein the seal ring is a resilient metallic seal.

7. A cryopump as claimed in claim 6 wherein the seal is a polymer coated resilient metallic seal.

8. A cryopump as claimed in claim 7 wherein said polymer is a halogenated or perhalogenated alkenyl polymer, a halogenated or perhalogenated alkoxy polymer or a copolymer thereof having $C_1$ to $C_4$ repeat units, wherein said repeat units are substantially halogenated with fluorine, chlorine or combinations thereof.

9. A cryopump as claimed in claim 8 wherein the seal is a PTFE coated C-ring.

10. A cryopump comprising:

a cryogenic refrigerator;

a cryopanel of aluminum shaped as a trough and coated with a corrosion resistant polymer; and a conductive link between the refrigerator and cryopanel, the conductive link comprising an aluminum post-cold link coated with a corrosion resistant polymer, a soft high conductivity material pressed between opposing surfaces of the refrigerator and post and opposing surfaces of the post and cryopanel, and respective seal rings surrounding the pressed material.

11. A cryopump as claimed in claim 10 wherein said soft material is indium.

12. A cryopump as claimed in claim 11 wherein said corrosion resistant polymer is a halogenated or perhalogenated alkenyl polymer, a halogenated or perhalogenated alkoxy polymer or a copolymer thereof having $C_1$ to $C_4$ repeat units, wherein said repeat units are substantially halogenated with fluorine, chlorine or combinations thereof.

13. A cryopump as claimed in claim 12 wherein each seal ring is a resilient metallic seal.

14. A cryopump as claimed in claim 13 wherein each seal is a polymer coated resilient metallic seal.

15. A cryopump as claimed in claim 14 wherein said polymer is a halogenated or perhalogenated alkenyl or alkoxy polymer or a copolymer thereof having $C_1$ to $C_4$ repeat units, wherein said repeat units are substantially halogenated with fluorine, chlorine or combinations thereof.

16. A cryopump as claimed in claim 15 wherein the seal is a PTFE coated C-ring.

17. A cryopanel comprising:

a panel of high conductivity material; and a coating on the panel of a polymer which is corrosion resistant, wherein said corrosion resistant polymer is a halogenated or perhalogenated alkenyl or alkoxy polymer or a copolymer thereof having $c_1$ to $c_4$ repeat units, wherein said repeat units are substantially halogenated with fluorine, chlorine or combinations thereof.

18. A cryopanel as claimed in claim 17 wherein the high conductivity material is aluminum.

19. A cryopanel as claimed in claim 18 wherein the aluminum is shaped as a trough.

20. A conductive link between a refrigerator and a cryopanel, the conductive link comprising soft, high conductivity material pressed between opposing surfaces and a seal ring surrounding the pressed soft, high conductivity material.

21. The conductive link of claim 20 wherein the soft material is indium.

22. The conductive link of claim 21 wherein the seal ring is a resilient metallic seal.

23. The conductive link as claimed in claim 22 wherein the seal is a polymer coated resilient metallic seal.

24. The conductive link as claimed in claim 23 wherein said polymer is a halogenated or perhalogenated alkenyl polymer, a halogenated or perhalogenated alkoxy polymer or a copolymer thereof having $C_1$ to $C_4$ repeat units, wherein said repeat units are substantially halogenated with fluorine, chlorine or combinations thereof.

25. The conductive link as claimed in claim 24 wherein the seal is a PTFE coated C-ring.

* * * * *